US012091219B2

(12) United States Patent
Koenigseder et al.

(10) Patent No.: US 12,091,219 B2
(45) Date of Patent: Sep. 17, 2024

(54) CLOSURE FOR A CONTAINER AND CONTAINER WITH SUCH A CLOSURE

(71) Applicant: Aptar Freyung GmbH, Freyung (DE)

(72) Inventors: Bruno Koenigseder, Roehrnbach (DE); Daniel Frey, Grainet (DE)

(73) Assignee: Aptar Freyung GmbH, Freyung (DE)

( * ) Notice: Subject to any disclaimer, the term of this patent is extended or adjusted under 35 U.S.C. 154(b) by 285 days.

(21) Appl. No.: 17/605,405

(22) PCT Filed: Apr. 29, 2019

(86) PCT No.: PCT/EP2019/060923
§ 371 (c)(1),
(2) Date: Oct. 21, 2021

(87) PCT Pub. No.: WO2020/221418
PCT Pub. Date: Nov. 5, 2020

(65) Prior Publication Data

US 2022/0234791 A1 Jul. 28, 2022

(51) Int. Cl.
*B65D 41/34* (2006.01)
*B65D 47/08* (2006.01)
*B65D 55/16* (2006.01)

(52) U.S. Cl.
CPC ..... *B65D 41/3428* (2013.01); *B65D 47/0833* (2013.01); *B65D 55/16* (2013.01)

(58) Field of Classification Search
CPC ..... B65D 41/3428; B65D 47/0833; B65D 55/16; B65D 41/485; B65D 41/3423; B29C 53/02
See application file for complete search history.

(56) References Cited

U.S. PATENT DOCUMENTS 6,372,167 B1 * 4/2002 Morini ..... B29C 69/02 264/296
8,636,160 B2 * 1/2014 Park ..... B65D 50/04 215/208
9,868,570 B2 * 1/2018 Ferrari ..... B65D 47/0842
11,780,653 B2 * 10/2023 Rognard ..... B65D 51/242 215/235

FOREIGN PATENT DOCUMENTS

DE 10 2006 001322 A1 7/2007
KR 100 981 240 B1 9/2010
WO 2007/026194 A1 3/2007
WO 2015/128071 A1 9/2015

OTHER PUBLICATIONS

International Search Report and Written Opinion dated Feb. 17, 2020.

* cited by examiner

*Primary Examiner* — Donnell A Long
(74) *Attorney, Agent, or Firm* — Wood, Phillips, Katz, Clark & Mortimer

(57) ABSTRACT

The present invention relates to a closure for a container with a base element and a flip-top lid attached to said base element by a hinge. The flip-top lid can be moved between an opened and a closed position. The base element has a skirt with attachment means for attaching the closure to the container, and said flip-top lid has a top cover and a sidewall. The closure comprises an actuating region with a latching element, wherein said actuating region is tiltable and/or deformable relative to the remaining regions of the sidewall between a latching position and a released position. The present invention also relates to a container with such a closure.

18 Claims, 8 Drawing Sheets

CLOSURE FOR A CONTAINER AND CONTAINER WITH SUCH A CLOSURE

FIELD OF THE INVENTION

The present invention relates to a closure or a closure device for a container and to a container provided with such a closure.

BACKGROUND OF THE INVENTION

Such a closure or dispensing device is especially used for dispensing products contained in a container to which said closure or dispensing device is attached.

The products to be dispensed are typically fluid products, like e.g. liquids or powdered or granular products, e.g. in the food or beverage area, but also in other applications, e.g. for cleaning substances, detergents or other products.

The present invention especially relates to a closure having a flip-top lid being attached to a base element by a hinge, while such a flip-top lid can be moved between an opened and a closed position, while the flip-top lid is typically essentially rotated around the hinge between its open and its closed position.

Such a closure is e.g. known from U.S. Pat. No. 7,051,888 B2.

It is an object of the present invention to provide an enhanced closure or dispensing device with a base element and flip-top lid attached to said base element, especially providing a closure which is easy to use and which has enhanced properties.

BRIEF SUMMARY OF THE INVENTION

This object is solved by a closure for a container according to claim 1 and a container with such a closure according to claim 18.

The claims refer to specifically advantageous realizations of the closure according to the present invention and to a specifically advantageous realization of a container with such a closure.

According to the present invention the closure for a container comprises a base element and a flip-top lid, while said flip-top lid is attached to said base element by a hinge such that the flip-top lid can be moved between an opened and a closed position. The base element of said closure has a skirt with attachment means for attaching the closure to the container, and said flip-top lid has a top cover and a sidewall. The attachment means of the skirt can be realized in various forms, e.g. by snap-on elements or internal threads or any other means.

Typically, the sidewall of said flip-top lid has an essentially cylindrical form, typically with an essentially circular cross-section, but other forms, like e.g. an oval cross-section form, are also possible.

The top cover of said flip-top lid may have different forms, preferably the top cover is essentially flat or plate-like, with an upper plane preferably being normal or perpendicular to the length or a vertical axis (x-axis) of an essentially cylindrical closure, while this length or vertical axis (x-axis) typically corresponds to a dispensing direction or a length axis through a neck of a container to which the closure has to be attached.

Such a length axis therefore defines a vertical direction (x-direction) of the closure, the vertical upward direction therefore corresponds to a direction being parallel to the length axis of the closure and being perpendicular to a top cover, if this top cover is a flat cover or a plate, so that the top cover, if being a flat cover, extends in a y-z-plane. As mentioned above, this vertical upwards direction also corresponds essentially to a dispensing direction, being perpendicular or normal to a plane defined by the opening of a neck of a container to which the closure will be attached.

Consequently, an outward or radially outward direction (in a y-z-plane) is a direction being perpendicular to the vertical axis (x-axis).

According to the present invention, the sidewall of said flip-top lid comprises an actuating region with a latching element, whereas said latching element is positioned at an inner surface of said actuating region or a surface, being directed radially inwardly of the closure. Said latching element is therefore disposed at a radially inward side of the sidewall of said flip-top lid.

According to the present invention, said actuating region is tiltable and/or deformable relative to the remaining regions of said sidewall, between a latching position and a release position. The actuating region with said latching element is arranged and constructed and designed such that said latching element is, when being in its latching position, engageable with a corresponding latching portion of a container, especially with a corresponding latching portion at the neck of the container. Therefore, when the closure is attached to the container and when the flip-top lid is in its closed position, and when said actuating region is in its latching position, the latching element is engaged with a corresponding latching portion of the container.

The closure is arranged and constructed such that the flip-top lid cannot be moved out of its closed position when said latching element of said actuating region is engaged with the corresponding latching portion of the container.

According to the present invention the actuating region has, at an outer surface thereof, or at a radially outer surface thereof, an operating element. This operating element extends outwardly or radially outwardly from said actuating region and can be operated by a user. According to the invention said operating element extends at least partly in a circumferential direction over a certain angular range of the closure while it is optionally also possible that the operating element extends over a certain height or in a vertical direction, as the operating element may be e.g. curved or arched.

According to the present invention said actuating region is partly separated from the remaining regions of the sidewall of said flip-top lid by a slot or a slit, which is provided in said sidewall or between the remaining regions of said sidewall and said actuating region, while said slit extends at least partly in a circumferential direction of the closure over a certain angular range ($\alpha$).

The slit can extend only in a circumferential direction, being essentially at the same vertical position of the closure in each angular position over at least a large part of its extension, but it is also possible and even preferred that the slit extends over a certain height or vertical distance of the closure. The slit may therefore extend also in an x-direction, preferably into a downward direction or in a direction towards the base element or a lower rim of the sidewall of the flip-top lid.

Further, said actuating region is connected with the remaining regions of the sidewall of said flip-top lid by at least one deformable hinge section biasing said actuating region into its latching position.

Such a closure as defined in claim 1 has remarkable enhanced properties, and such a closure is especially easy to open for a user, while still an accidental or unintended opening of the closure is avoided, e.g. in a situation where a container with such a closure is transported in transporting means like bags etc.

The necessary force to be applied by a user to open the closure as defined in claim 1, namely by applying a force onto the operating element in order to open the closure, can be kept low, while still there is a high security avoiding inadvertent opening of the closure during transportation.

The inventors have found out that the specific arrangement of the closure according to claim 1, especially with the actuating region, the slit partly separating the actuating region from the remaining regions or other parts of the sidewall of said flip-top lid, and the provision of the operating element and the at least one deformable hinge section leads to the effect that a relatively low amount of force is necessary to disengage said latching element of said actuating region of said closure from the corresponding latching portion of the container, especially due to the fact that a user applies such a force typically in a very specific direction, namely not only in an upward or vertical direction, but in a direction having also a radially inward component. Very typically the users do apply a force onto such an operating element in a direction being tilted from the strictly vertical direction (parallel to a longitudinal or vertical axis of the closure) typically being 30° to 60°, more typically being in the area of 40° to 50° tilted in the radially inward direction from the vertical direction.

On the other hand, if a container with such a closure is transported in some kind of transporting means, like e.g. bags as mentioned above, the closure may be opened when a force is inadvertently applied to the flip-top lid. But frequently or mostly such a force is not applied not in the same direction as a force applied by a user in order to open the closure. Very frequently there is just another element hitting against the flip-top lid, e.g. against a top plate of the flip-top lid, but in a purely or essentially mainly vertical direction.

The closure as defined in claim 1 has the surprising advantage that the amount of force necessary to open the closure and to disengage said latching element of said actuating region from the corresponding latching portion of the container is remarkably higher when the force is applied in a vertical direction compared to a situation where the force is applied in a direction in which the user normally applies a force to the operating element when, on purpose, trying to open the closure.

In this respect it is referred to FIG. 13: As can be seen in FIG. 13, a user, when, on purpose, opening the flip-top lid, will typically assert a force ($F_U$) onto the operating element (450), while the force ($F_U$) has both a vertical component (in x-direction) and a component in a radially inward direction, therefore a component in a direction of an y-z-plane. Very typical the direction of force ($F_U$) applied by a user is tilted by about 40° to 50° relative to the vertical axis.

On the other hand, during transportation, frequently unintended forces are applied to the flip-top lid, which bear the risk of an unintended opening of the flip-top lid, especially e.g. vertically directed forces ($F_A$) applied against the top plate 210 of a closure.

The closure as defined in claim 1 is therefore perfectly adapted in order to keep the necessary opening force for a user and for a desired opening low, while still having a high security function and avoiding, to a large extent, inadvertent opening, as keeping the necessary force higher when the direction of the inadvertent force applied to the flip-top lid is in a direction different to the typical direction of a user applied to the closure for an opening. The closure according to the invention is therefore easy to use and to open for a user, while still being very secure for transportation.

When again referring to FIG. 13, the closure according to the present invention has especially the advantage that the necessary amount of force applied to the flip-top lid, which would result into an opening of the closure (or, in other words, a disengagement of said latching element of said actuating region from a corresponding latching portion of a container) is remarkably lower, when such a force is applied to an operating element and in a direction, into which the user would typically apply the force ($F_U$), when compared to a vertical direction (force $F_A$), which frequently happens due to inadvertent situation e.g. during transport.

According to a preferred embodiment said closure comprises at least one frangible bridge, connecting said skirt of said base element with said sidewall of said flip-top lid, preferably with said actuating region of said sidewall of said flip-top lid. Such a frangible bridge is arranged such that it is destroyed when said latching element of the actuating region is disengaged from the corresponding latching portion of the container for the first time, in other words, it is disengaged when the closure is opened by the user for the first time.

Such a frangible bridge therefore realizes a so-called temper-evident element (TE element), which, after having been broken, clearly indicates to the user or a third person that the closure has been opened once, so that the closure is not in its original status any more.

According to a further preferred embodiment the slot or slit in said sidewall or the slit separating the actuating region from the remaining regions of the sidewall extends in a circumferential direction of said sidewall by an angle of 20° to 120°, preferably by an angle of 30° to 90° and even further preferably by an angle of 50° to 70°.

Further preferably the closure provides at least two deformable hinge sections, in a preferred embodiment directly adjacent to each end of the slit or slot. Such a realization does, in a specifically advantageous form, enable a well-working actuating region, which can be tilted and/or deformed by a relatively low amount of force of the user in order to open the closure.

The exact adaption of the force can be of course influenced and selected by choosing the length of the slit and the thickness of the material of the at least one, preferably two deformable hinge sections, and of course of the material chosen.

Typically such closures are made from plastic material, which can be injection molded, e.g. Polypropylene PP or others.

According to a preferred embodiment, the slot or slit does not solely extend into a circumferential direction, but the slit also at least partly extends into a direction perpendicular to said circumferential direction or at least with a component being perpendicular to said circumferential direction. The slit can be also curved or arched. By this preferred arrangement, there are more varieties to influence the amount of tiltability or deformability of the actuating region relative to the remaining regions of the sidewall and to especially influence the geometrical dimensions of the at least one deformable hinge section.

According to another preferred embodiment the slot or slit has a width in the area of 0.2 mm to 1.5 mm, preferably in the area of about 0.4 mm to 1.2 mm and further preferably in the area of about 0.6 mm to 1.0 mm.

Such sizing has the advantage that a secure operating of the closure can be achieved, while at the same time not disturbing the outer surface of the closure, thereby both retaining a good optical appearance and a secondly reducing the possibility of external material entering through the slit.

According to a preferred embodiment the closure is arranged and constructed such that a tilting angle of said actuating region or an angle between the latching position and the release position of said actuating region is at least 5°, preferably of at least 10° and more preferably at least 15°.

The tilting angle is preferably measured between a vertical axis (x-axis) of the sidewall or the remaining portions of the sidewall, or a vertical axis (x-axis) of the closure as described and defined above, in comparison to a tangent to the actuating region when being its latching position when viewed in a vertical cross-section (see e.g. FIG. 5 or FIG. 6).

These dimensions are especially preferred in order to on the one hand secure a reliable functioning of the device, with a clear distinction of the actuating region being either in its latching position or in its releasing position, while on the other hand also securing a high resistance against inadvertent opening.

In a specifically preferred embodiment the closure is constructed such that an axis (R) of tilting or rotating of said actuating region is positioned below said operating element or in an area between said operating element and said latching element of said actuating region. The specific geometrical arrangement has the effect that the direction of force, typically applied by a user when operating the operating element in order to open the closure, enhances a rotating or tilting of the actuating region, so that the necessary opening force applied by a user for opening the closer can be kept low, while, as mentioned above, still avoiding an inadvertent opening of the closure during transport, when a force is applied to the closure, especially the flip-top lid, in different direction, specifically in an essentially upward or vertical direction.

In a specifically preferred embodiment the closure is constructed and arranged such that the axis (R) of tilting or rotation is arranged such that a straight line (L) connecting this axis (R) of tilting or rotating with said most outward point of said operating element forms an angle (β) with said sidewall of said flip-top lid or with a vertical direction (x-direction) of a closure, as explained and defined above, in a range of about 30° to 60°, preferably between 40° and 50°, with 45° being a specifically preferred embodiment. Also, this specific geometric arrangement enhances the above-mentioned function, namely keeping the amount of an opening force, when applied by a user in the typical direction, can be kept low, while avoiding an inadvertent opening by a force applied in a different direction, especially a vertical direction.

Preferably, the necessary amount of a force applied onto said operating element by the user in order to disengage said latching element of said actuating region from the corresponding latching portion of the container is higher when a force ($F_A$) applied onto said flip-top lid in a vertical upward direction compared to a force ($F_U$) which is applied onto said operating element having also a radially inward directed component, being a typical direction applied by a user to an operating element when opening the closure on purpose.

In a preferred embodiment said operating element extends in a circumferential direction of said sidewall by an angle of 20° to 120°, preferably 30° to 90°, further preferably by 50° to 70°. This extension secures a convenient size of the operating element such that the user can easily operate the closure and especially the operating element.

Preferably, said operating element is at least partly curved, preferably arched towards the position of the slit in the sidewall or arched in a vertical upward direction (x-direction). This has the advantage that a user can easily place his or her finger onto or into said operating element, which enhances the ease of operation and lowers the pressure felt by a user on his or her finger.

The dimensions of the operating element can be selected depending on the specific product, preferably the operating element extends, in a radial outward direction from the sidewall, by a distance of 1 mm to 10 mm, preferably by a distance of 1 mm to 5 mm, and more preferably by a distance of 1 mm to 3 mm, realizing a very good relationship of a size of the operating element to be easily operated by a user, while still minimizing the risk of an inadvertent applying of force onto said operating element while transporting a container with such a closure.

According to a preferred embodiment the closure comprises at least one further frangible bridge, bridging said slit or slot in said sidewall. This further frangible bridge is arranged such that it is destroyed when said latching element of the actuating region is disengaged from the corresponding latching portion of the container for the first time.

Thereby an additional TE-element is realized, which enhances the TE-function of the closure even further.

According to another preferred embodiment at least part of the slit or slot separating said actuating region from the remaining regions of the sidewall is covered or closed by a frangible skin. In one embodiment this frangible skin covers a complete slit or slot. Thereby a very well visible TE-element is realized. Furthermore, the risk of potential entry of dust or other materials through the slit or slot can be reduced or, in case the frangible skin covers or closes the complete slit or slot, fully avoided.

The frangible skin is, according to preferred embodiment, made from the same material as the closure, but in principle it would be also possible to have the frangible skin made from a different material. The frangible skin may be very thin, preferable the thickness of such a frangible skin is in a range of 0.01 mm to 0.2 mm, preferably in the range of 0.05 mm to 0.1 mm.

The frangible skin can be applied at the outside of the slit or slot, according to another embodiment, however, it can be provided at the inner side of the slot or the sidewall respectively. It would be also possible to provide a skin within the thickness or the radial extension of the slit or slot. Such a frangible skin can be e.g. manufactured by injection molding in one manufacturing step together with the closure, however, it is also possible to apply the frangible skin separately and after the closure has been injection molded. According to one realization, the frangible skin can e.g. applied on the outside of the sidewall and over the slit or slot, partly or completely.

According to a further preferred embodiment said base element has an upper rim, where said upper rim or said skirt has a recess extending over a predetermined angular range in the circumferential direction. Furthermore, in this preferred embodiment, said sidewall of said flip-top lid has a lower rim, with said lower rim or said sidewall having a protrusion extending over a predetermined angular range in the circumferential direction. Thereby, the protrusion of said sidewall of said flip-top lid extends into said recess of said skirt of said base element when said flip-top lid is in its closed position.

This has the advantage of realizing a good optical appearance, emphasizing the "operating area" of the closure to the user and providing sufficient space for the functional elements of the closure according to the invention, namely the actuating region, the operating element and the slit or slot at least partly separating the actuating region from the remaining regions of the sidewall, while especially the vertical dimensions of the closure can be minimized, thereby realizing a low height closure and minimizing the amount of material, which is a very relevant cost factor.

Furthermore, the closure can be attached to a container with a neck having only one protruding portion, e.g. a protruding ring, which then acts as a latching portion of the container for coming into engagement with a latching element of the actuating region of the closure, while the attachment means at the skirt of the base element of the closure can use the same protrusion or ring-like element of the container for attaching the closure to the neck of the container.

According to another preferred embodiment, said closure comprises a folding strap or folding ring attached to said skirt of said base element for attaching and/or fastening said closure to the container, especially to the neck of the container. Such a folding ring can serve as attachment means to the neck of a container, in a preferred embodiment using a ring-like protrusion or the only ring-like protrusion at the outside of a neck of a container, as explained above.

According to a preferred embodiment, said latching element of said actuating region comprises a protrusion at an inner surface of said sidewall, while said protrusion can engage with and interact with a corresponding protrusion at the container, preferably at the outside of a neck of a container. Alternatively, it would be also possible that said latching element of said actuating region comprises a recess at an inner surface of said sidewall, which also can engage with and interact with a protrusion at the neck of a container.

According to a preferred embodiment, the thickness of the actuating region is higher in an upper region than in a lower region or in a vertical upper region than in a vertically lower region (in x-direction). The thickness of the actuating region is preferably smaller in a region further away from the latching element than in a region being closer to the latching element. Such a realization has the advantage that a maximum angle of tilting can be increased, as the maximum angle of tilting is also limited by the geometric realization of a neck of a container to which the closure is attached. The neck of a container may e.g. also comprise outer threads, such that it is also suitable for closures which are screwed onto the neck, even if the closure is, as in the preferred form, no screw-on closure.

The present invention also relates to a container for holding a flowable medium, wherein the container comprises a neck with a dispensing opening and with attachment means for attaching a closure, while said container comprising a closure as explained above.

In a preferred embodiment, said container comprises a ring-like protrusion, and in some embodiments only one ring-like protrusion, at the outer surface of said neck, thereby forming a latching portion which is engaged with the corresponding latching element of said actuating region when said flip-top lid is in its closed position and when said actuating region is in its latching position.

BRIEF DESCRIPTION OF THE DRAWINGS

These and other features and advantages of a closure and container according to the present invention will become more apparent in view of the embodiments shown in the enclosed Figures and described hereinafter.

DETAILED DESCRIPTION OF THE PREFERRED EMBODIMENTS

Figure 1:
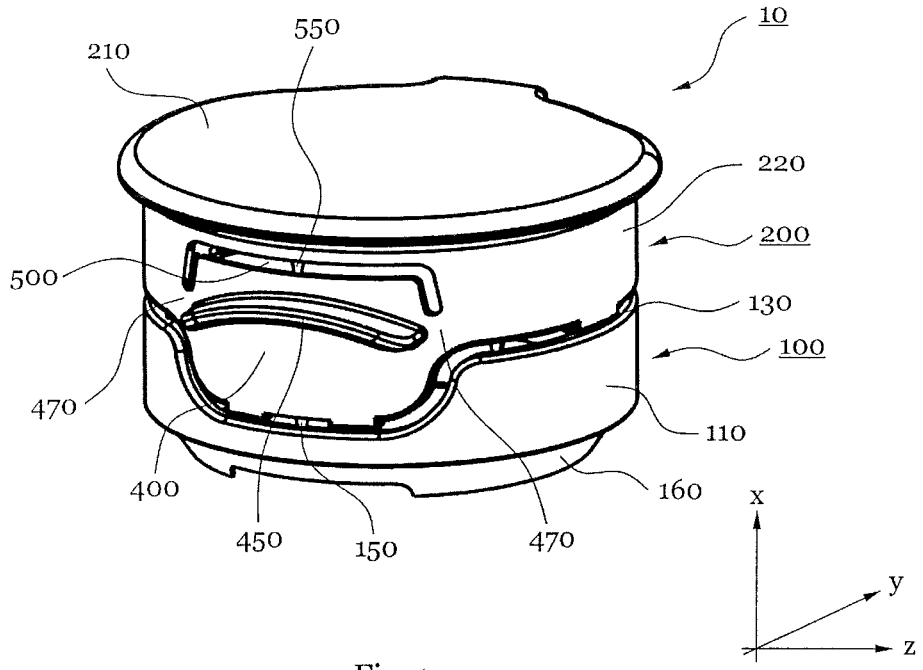
FIG. 1 shows a perspective view of an embodiment of the closure according to the present invention.
Figure 2:
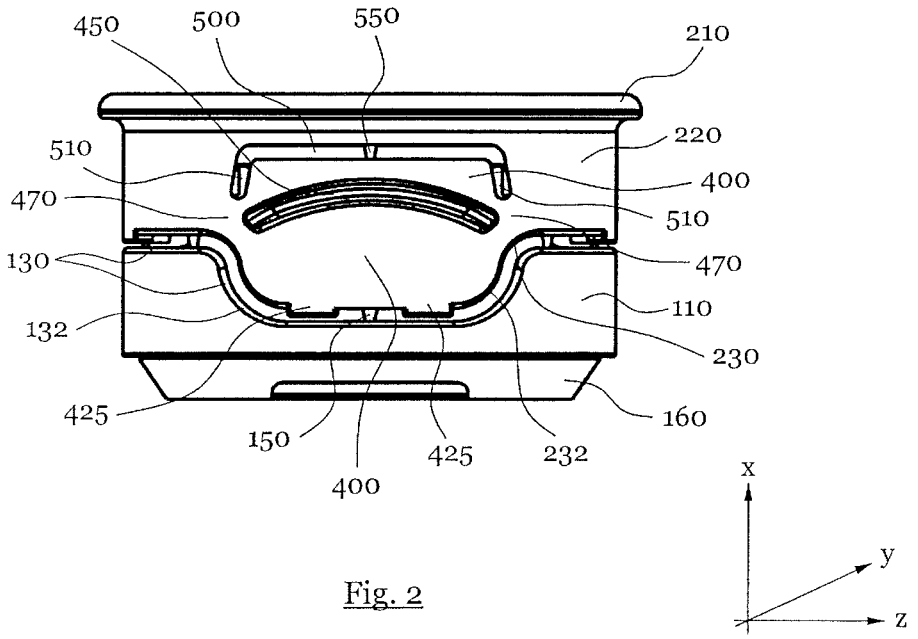
FIG. 2 shows a front view of the closure as shown in FIG. 1.

FIGS. 1 and 2 show both a perspective view and a front view of an embodiment of a closure 10 according to the present invention. The closure 10 comprises a base element 100 and a flip-top lid 200, which is connected by a hinge to the base element 100 such that the flip-top lid 200 can be moved between an opened and a closed position, with FIGS. 1 and 2 showing the lid in its closed position.

Figure 3:
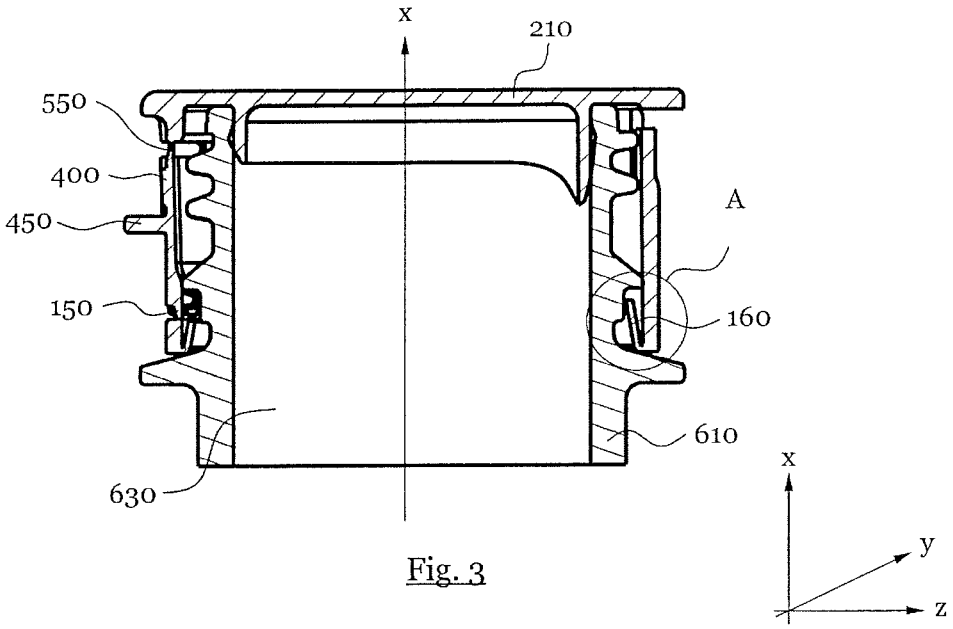
FIG. 3 shows a cross-sectional view through the embodiment as shown in FIG. 1, with the actuating region being in its latching position.
Figure 4:
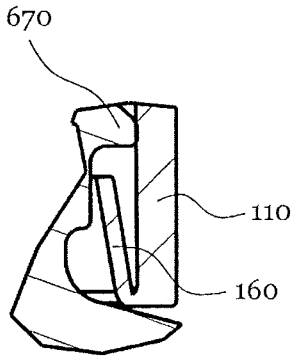
FIG. 4 shows an enlarged portion of the area A as shown in FIG. 3.

As can be well seen in both FIGS. 1 and 2, said base element 100 has a skirt 110, which can be attached to a container with attachment means, see especially FIG. 3 and FIG. 4. The flip-top lid 200 comprises a top cover 210 and a sidewall 220. The sidewall 220 is essentially cylindrical and the top cover 210 is essentially flat, while it has been mentioned that the top cover can also have different forms.

As can be well seen in FIGS. 1 and 2, the closure comprises an actuating region 400, which is partly separated from the remaining regions of the sidewall 220 by a slit 500.

The slit 500 extends, in a circumferential direction of the closure 10, over an angular area of about 60° and has extensions 510, at both sides, comprising a component also in a vertical direction, here in a downward direction.

The actuating region 400 is connected with the remaining regions of the sidewall 220 of said flip-top lid 200 by two deformable hinge sections 470.

Furthermore, the closure comprises an operating element 450, which extends radially outwardly from said actuating region 400, while said operating element 450 also extends in a circumferential direction of the closure over an angular range of about 60° whereas said operating element is slightly curved or arched, such that a finger of a user can easily be placed on the lower side of the operating element to operate and to open the flip-top lid.

The base element too comprises a folding strip 160 for attaching and/or fastening said closure to a container, as will be explained in some more detail in connection with FIG. 3 and FIG. 4 hereinafter.

Furthermore, the closure of this embodiment comprises one frangible bridge 150, connecting said skirt no of said base element too with the actuation region 400 of said flip-top lid 200. The frangible bridge is shown in its undestroyed position, therefore in a position before a first opening of the flip-top lid 200 by a user. This frangible bridge 150 is arranged such that it is destroyed when said latching element 420 of the actuating region 400 is disengaged from the corresponding latching portion of a container (not shown) for the first time.

This frangible bridge 150 thereby acts as a temper-evident element (TE-element), while this frangible bridge 150 is destroyed when said latching element of the actuating region is disengaged from the corresponding latching portion of the container for the first time, thereby indicating to a user that the closure to has been opened at least once.

The closure 10 according to this embodiment further comprises an additional frangible bridge 550, bridging said slit 500. Also this additional frangible bridge 550 is arranged such that it is destroyed when said latching element 420 of the actuating region 400 is disengaged from the corresponding latching portion of a container (not shown) for the first time, thereby also serving as an additional TE-element.

As can be also well seen in FIGS. 1 and 2, the skirt 110 of said base element 100 in this specific embodiment has an upper rim 130 having a recess 132 extending over a predetermined angular range in the circumferential direction. Furthermore, the sidewall 220 of said flip-top lid 200 has a lower rim 230, whereas said lower rim 230 or said sidewall 220 has a protrusion 232 also extending over a predetermined angular range in the circumferential direction. The protrusion 232 of said sidewall 220 of said flip-top lid 200 extends into said recess 132 of said skirt 110 of said base element, when said flip-top lid 200 is in its closed position.

As can be especially seen in FIG. 2, the lower rim 230 of said sidewall 220 has, in the area of said protrusion 232, two further extensions 425. On the backside of these extensions 425, the latching elements (420, see especially FIG. 6) are arranged. In this embodiment there are two latching elements, but it is possible to have either only one latching element or more than two latching elements.

FIG. 3 shows a cross-section through the closure as shown in FIGS. 1 and 2, also in a condition before a first opening, therefore with the frangible bridges 150 and 550 undestroyed and with the actuating region 400 being in its latching position.

As can be well seen in FIG. 3 and especially in the enlargement A shown in FIG. 4, the closure is attached to a neck 610 of a container wherein the neck 610 of the container comprises attachment means (see FIG. 4) in the form of a ring-like protrusion 670.

When attaching the closure 10 to the neck bio of the container, the folding strap 160 is folded upwardly, so that the folding strap 160 engages with the attachment means 670 of the closure 10 such that the closure 10 cannot be removed from the neck 610 of the container.

Figure 5:
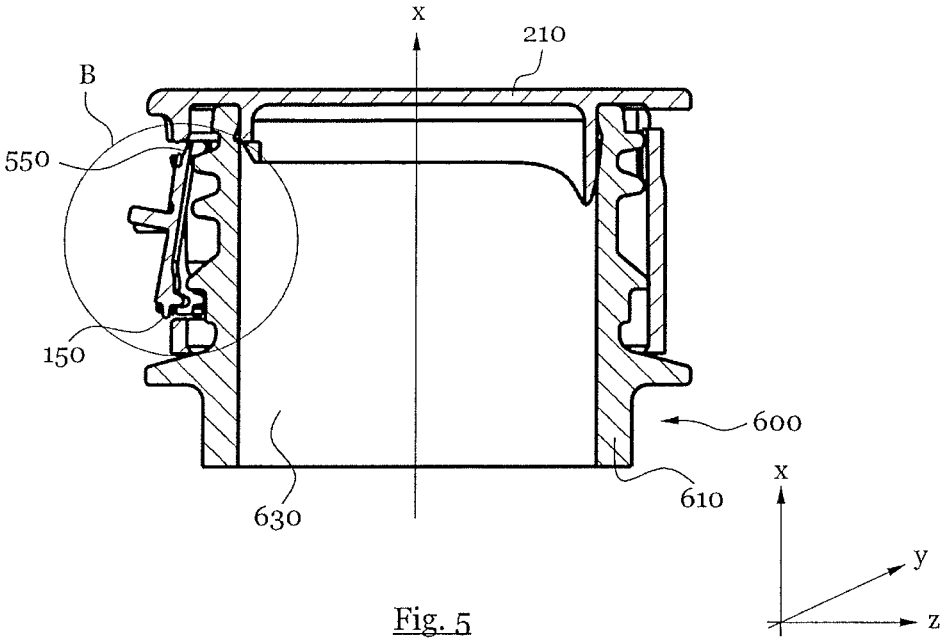
FIG. 5 shows a cross-sectional view of the embodiment as shown in FIG. 3, however with the actuating region in its release position.
Figure 6:
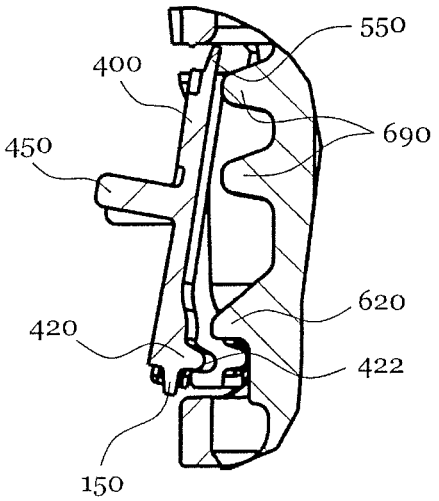
FIG. 6 shows a cross-section of part (B) as shown in FIG. 5 in an enlarged view.

FIGS. 5 and 6 show the embodiment of the closure 10 in a cross-section, identical to FIGS. 3 and 4, however with the actuating region 400 being moved in its release position, being tilted or rotated relative to the remaining regions of the sidewall.

The tilting or rotating angle in this embodiment is about 9°, which is a preferred tilting or rotating angle, but this angle could vary in other embodiments, typically being in a range of 5° to 20°.

Figure 7:
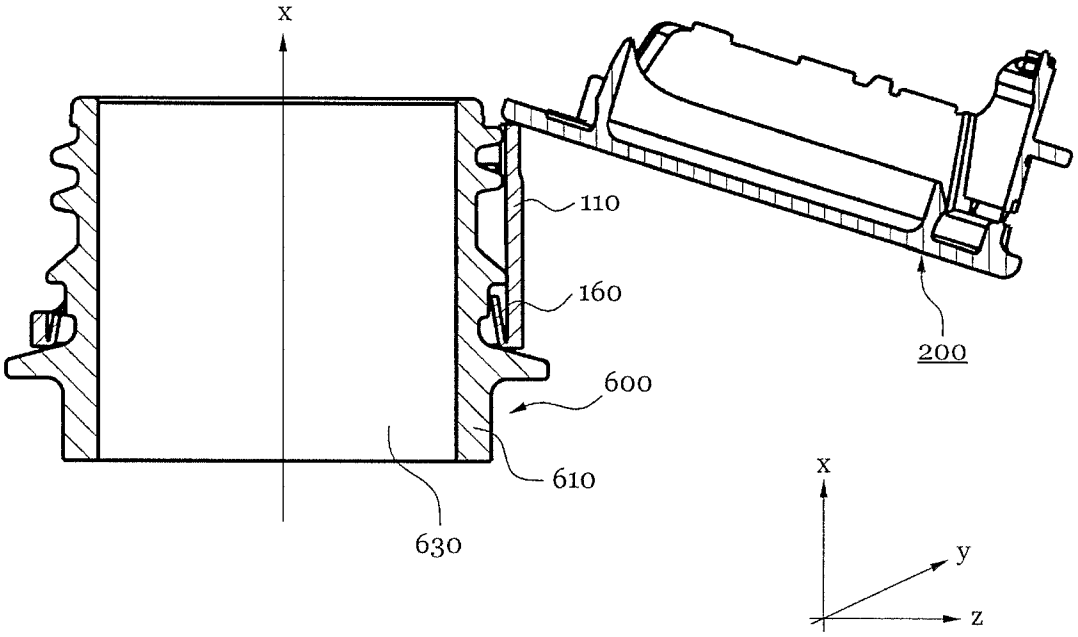
FIG. 7 shows a cross-section of the embodiment shown in the earlier Figures with the flip-top lid in its opened position.

As can be well seen especially in FIG. 6, the latching element 420 of said actuating region 400 is disengaged from the corresponding latching portion 620 of the container, so that the flip-top lid 200 can be moved in its open position (see FIG. 7).

Consequently, the frangible bridges 150 and 550, acting as TE-elements, have been destroyed and indicate to a user that said latching element 420 of the actuating region 400 has been disengaged from the corresponding latching portion 620 of the container 600 at least once, so that the flip-top lid has been opened or could at least have been opened.

As can be well seen especially in FIG. 6, the thickness of the actuating region 400 is higher at a lower region, close to the latching portion 620, while the thickness is smaller in an upper region. The specific thickness differences of the actuating region 400 have the advantage that, with a lower thickness at an upper region, the actuating region 400 can be tilted by a larger angle, as the maximum angle of tilting is also limited by the actuating region 400 abutting against some parts of a neck of a container, like e.g. an outer thread 690.

This may be of specific relevance in case the neck of a container has additional fastening means, such as e.g. an external thread 690, which in principle allows also a fastening of a thread-on closure.

FIG. 7 shows a cross-section of the embodiment of the closure 10 as shown in FIGS. 1 to 6, with the flip-top lid being in its opened position, so that a content, especially a fluid content stored in a container, can be dispensed through an opening 630 being provided in the neck 610 of the container 600.

FIG. 8 to FIG. 11 do show perspective views of further embodiments of a closure according to the present invention. Identical or similar elements are indicated with the same or similar reference numbers and in order to avoid repetitions, it is referred to the detailed explanation of the embodiments shown in FIGS. 1 to 7.

Figure 8:
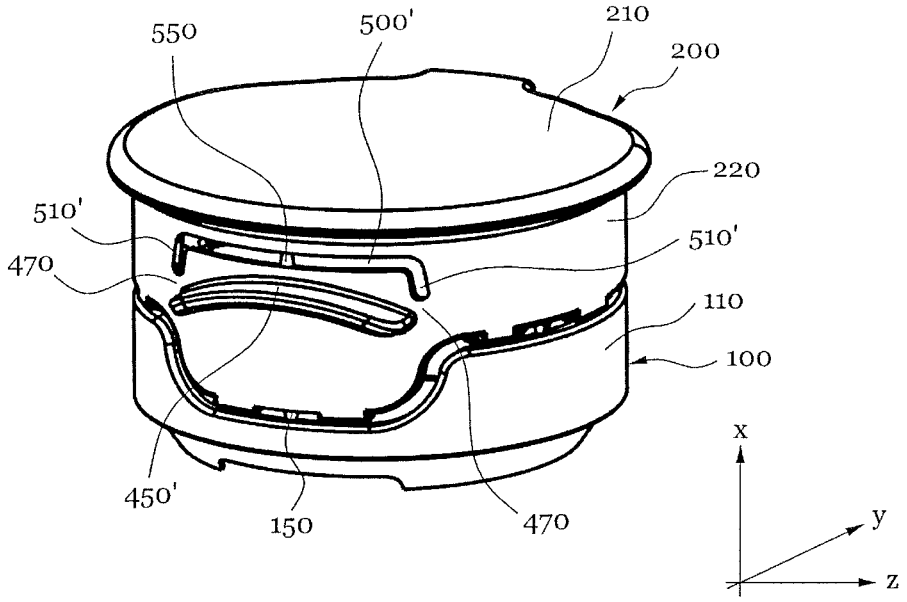
FIG. 8 shows a perspective view of a $2^{nd}$ embodiment of a closure according to the present invention.
Figure 9:
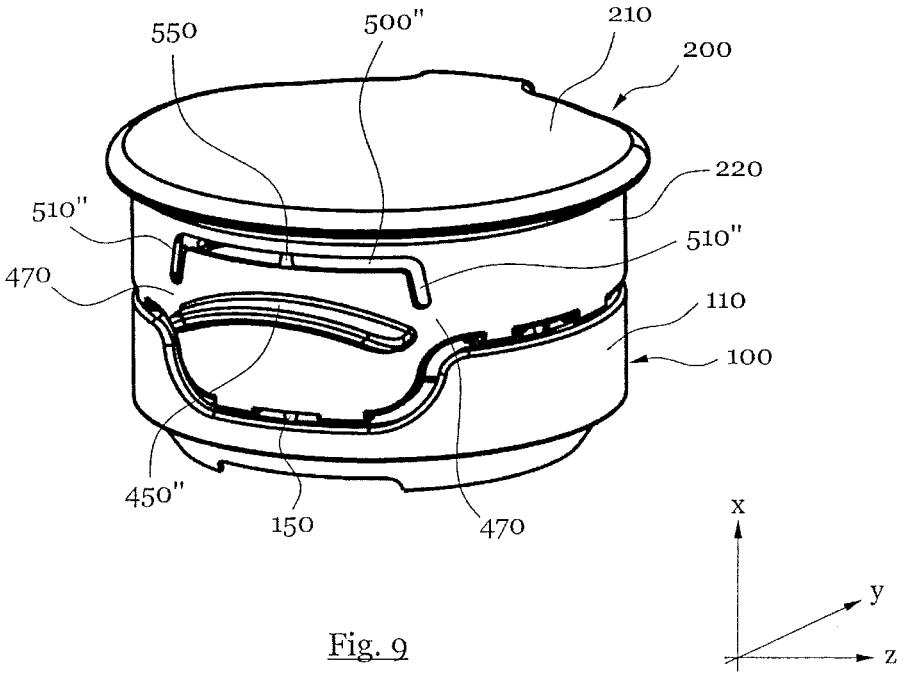
FIG. 9 shows a perspective view of a $3^{rd}$ embodiment of a closure according to the present invention.
Figure 10:
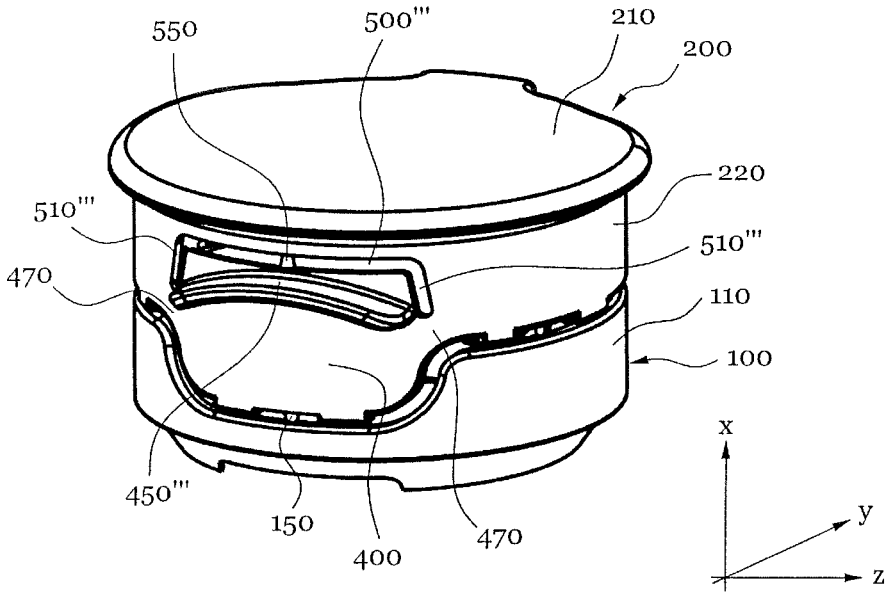
FIG. 10 shows a perspective view of a $4^{th}$ embodiment of a closure according to the present invention.

As can be especially seen in FIG. 8 to FIG. 10, the $2^{nd}$, $3^{rd}$ and $4^{th}$ embodiment are very similar to the $1^{st}$ embodiment of the closure according to the present invention, but the slit 500, 500', 500", 500''', 500'''', 510, 510', 510", 510''', 510'''' and the operating element 450, 450', 450", 450''', 450'''' are designed and positioned slightly different.

Figure 11:
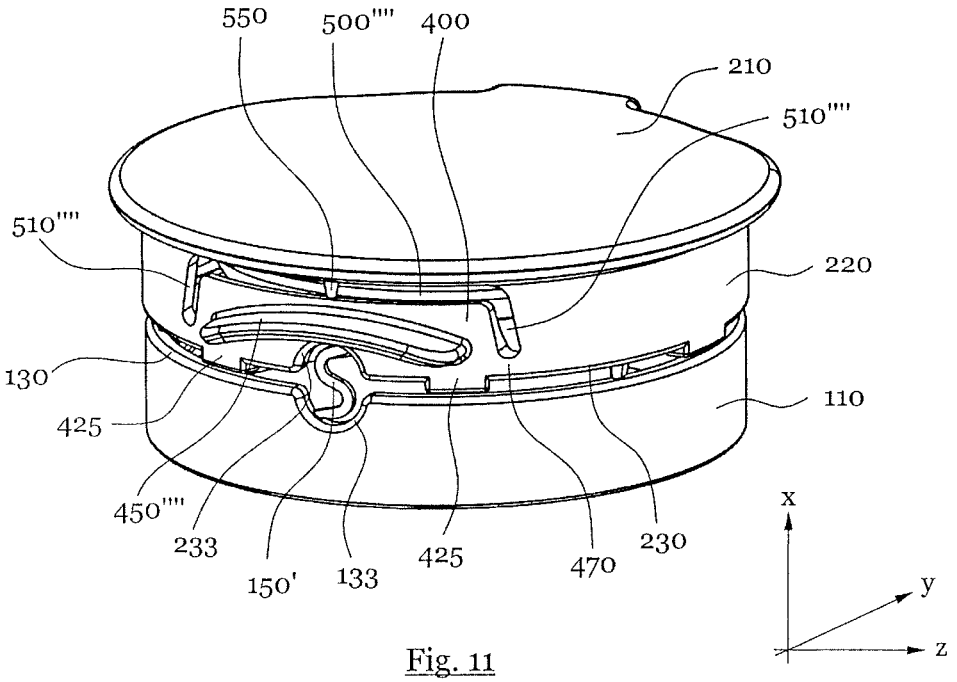
FIG. 11 shows a perspective view of a $5^{th}$ embodiment of a closure according to the present invention.

FIG. 11 shows a $5^{th}$ embodiment, which does not have a recess of the skirt 110 into which a corresponding protrusion of the sidewall 220 does extend, but the lower rim 230 of said sidewall 220 of said flip-top lid 200, as well as the upper rim 130 of said skirt 110 is extending in its circumferential directions, extending essentially on the same height.

The embodiment in FIG. 11 shows a very specifically designed frangible bridge 150', which connects the skirt 110 and the sidewall 220 and which will be broken or destroyed when the latching element of the actuating region 400 is disengaged from the corresponding latching portion of the container for the first time, as explained in connection with the first embodiment.

The frangible bridge 150' is in the form of an S and has a longer extension in a vertical direction, is placed in two smaller recesses 133, 233 in the respective rims 130 and 230 of the skirt 110 and the sidewall 220, respectively.

When this specific S-form frangible bridge is broken or destroyed, it will be specifically well-seen by a user, thereby realizing a very preferred TE-element.

Figure 12:
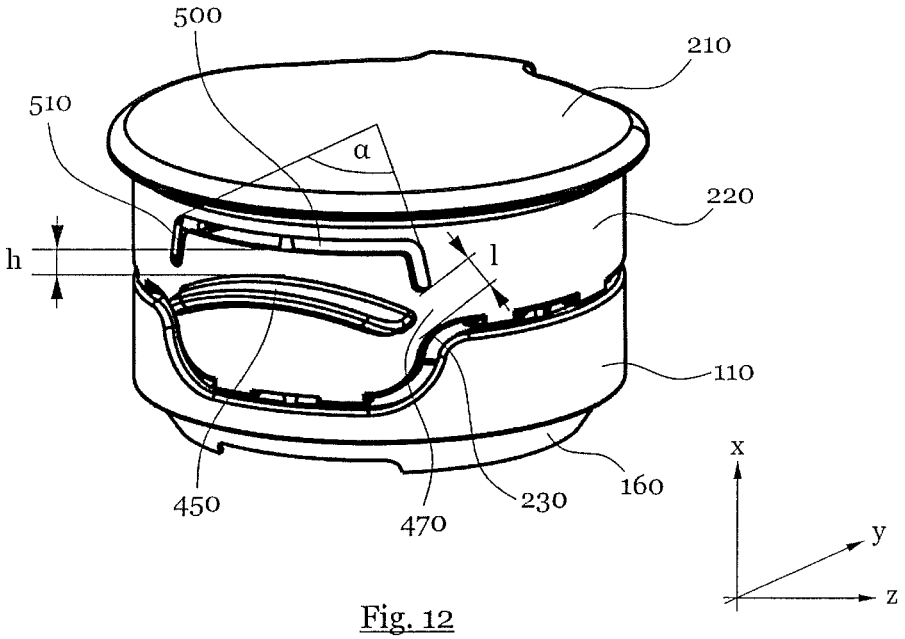
FIG. 12 shows a perspective view of another embodiment of the present invention, where certain dimensions are visualized.

With respect to the dimensions and realizations shown in the various embodiments it is especially referred to FIG. 12:

FIG. 12 visualizes some parameters for the different designs especially of the slit 500, 510 and the operating element 450. As explained above with respect to the embodiments, the slit 500, 510, extends over a certain angular range (α), and the operating element 450 is positioned in a certain height.

The distance between the most upper part of the operating element 450 to the slit 500 is designated as "h".

Furthermore, depending on the arrangements in the various designs and embodiments, the deformable hinge sections 470 have certain lengths, namely the length "l", being the shortest distance between the end of the slit 500, 510 to the lower rim 230 of the sidewall 220.

For the 1st to 5th embodiments, the dimensions for "h", the distance between operating element 450 and slit 550, as well as the length of the deformable hinge sections 470, length "l", and the angle (α), over which range the slit 500, 510 does extend in an angular direction are shown in the following table:

| | Picture of embodiment | Distance "h" | Length "l" of deformable hinge sections 470 | Angle (α) |
|---|---|---|---|---|
| 1st embodiment | FIGS. 1-7 | 1.5 | 2.57 | 65° |
| 2nd embodiment | FIG. 8 | 1.0 | 3.08 | 65° |
| 3rd embodiment | FIG. 9 | 2.0 | 2.57 | 65° |
| 4th embodiment | FIG. 10 | 0.5 | 2.06 | 65° |
| 5th embodiment | FIG. 11 | 0.65 | 1.12 | 70° |

Figure 13:
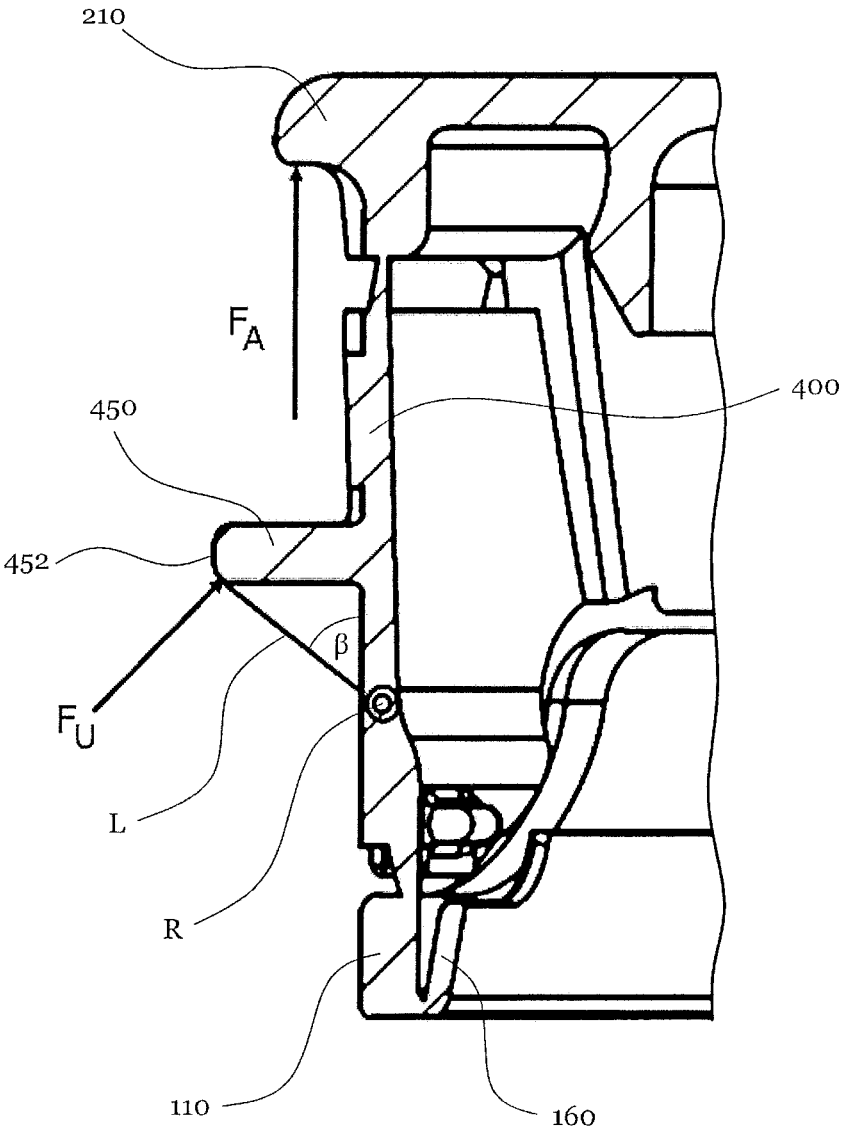
FIG. 13 shows a cross-section through a part of an embodiment of a closure according to the present invention.

As in detail explained above, the closures according to the present invention have especially the advantage that the necessary amount of force to realize a disengagement of the latching element 420 of said actuating region 400 from the corresponding latching portion 620 of the container 600 is lower, when the force is applied by a user against the operating element in a direction, which is not only vertical, but also has a radial inwardly directed component, namely a force $F_U$, see FIG. 13, when compared to a force which is applied only in a vertical direction, see force $F_A$ in FIG. 13.

For the 1st to the 4th embodiment shown and described above, measurements have been performed, while a force $F_U$ has been applied to the outmost point 452 of the operating element 450 in a direction being tilted 45° from the vertical direction (x-direction), see FIG. 13, and a necessary amount of the force to disengage the latching element 420 from the corresponding latching portion 620 has been measured. In comparison, a force $F_A$ has been applied to the top plate 210 in a vertical direction (x-direction), see also FIG. 13, and again the amount of force being necessary to disengage the latching element 420 from the corresponding latching portion 620 of the container has been determined. In comparison thereto, the same measurements have been performed with a comparative example, which is identical to the first embodiment, but which does not comprise a slit as the first embodiment.

The comparative example, i.e. a device essentially as shown in FIGS. 1 to 7, however without a slit, required an amount of force $|F_U|$ of 12.7 N to disengage the latching element 420 from the corresponding latching portion 620 of the container, while with respect to the amount of force $|F_A|$ applied in a vertical direction to the top plate 210, the amount of force necessary to lead to this disengagement was only 8.4 N.

The relationship between the amount of force "$|F_A|/|F_U|$" in this comparative example was therefore 0.66.

The amount of a force $F_A$, which may be accidentally applied to a top plate 210, is therefore remarkably lower than the necessary amount of a force $F_U$, a user has to apply in order to, on purpose, open the closure, so that an inadvertent open can easily happen, while an opening on purpose by the user requires a relatively high force to be applied by a user.

In contrast thereto, the present invention remarkably changes this relationship between the necessary amount of forces and leads to the opposite result, with a relationship between the amount of force "$|F_A|/|F_U|$" being not below 1, but being remarkably above, as can be seen from the following table:

| | $\|F_U\|$ | $\|F_A\|$ | $\|F_A\|/\|F_U\|$ |
|---|---|---|---|
| Comparative example | 12.7 | 8.4 | 0.66 |
| 1st embodiment | 3.95 | 8.5 | 2.15 |
| 2nd embodiment | 4.2 | 7.9 | 1.88 |
| 3rd embodiment | 4.8 | 9.1 | 1.90 |
| 4th embodiment | 1.84 | 4.29 | 2.33 |

The properties of the closures according to the present invention therefore are much better than those of a comparative example and the relevant relationship of $|F_A|/|F_U|$ is remarkably different.

FIG. 13 was already referred to above, especially with respect to the forces $F_A$ and $F_U$ applied to a closure. Additionally, FIG. 13 also shows, for one embodiment, the axis R of rotation or tilting, which is, according to preferred embodiments, arranged below (in a vertical direction, in x-direction) the operating element 450, or between the operating element 450 and the latching element of the actuating region 400.

As also already explained above, preferably the device and especially the actuating region 400 is arranged and constructed such that a straight line L connecting an axis R of tilting or rotating of said actuating region 400 with a radially most outward point 452 of said operating element 450 forms an angle (β) with said sidewall of said flip-top lid or the actuating region 400, in the vertical direction, in a range of about 30° to 60°, preferably between 40° and 50°, and, in the embodiment shown in FIG. 13, of about 45°.

Such an arrangement is of specific advantage in order to fulfill the above-mentioned functions and results, as in detail explained, in a preferred way.

The features of the present invention disclosed in the specification, the claims and/or in the accompanying drawings may, both separately and in any combination thereof, be material for realizing the invention in various forms thereof.

The invention claimed is:

1. A closure for a container, the closure comprising:

a base element;

a flip-top lid attached to said base element by a hinge such that the flip-top lid can be moved between an opened and a closed position;

said base element having a skirt with attachment means for attaching the closure to the container, said flip-top lid having a top cover and a sidewall, characterized in that said sidewall of said flip-top lid comprises an actuating region with a latching element, said latching element being positioned at an inner surface of said actuating region, wherein said actuating region is tiltable and/or deformable relative to the remaining regions of said sidewall between a latching position and a release position, said actuating region with said latching element being arranged such that said latching element is, when being in its latching position, engageable with a corresponding latching portion of the container, while the flip-top lid cannot be moved out of its closed position when said latching element of said actuating region is engaged with the corresponding latching portion of the container, said actuating region has, at an outer surface thereof, an operating element extending outwardly from said actuating region for being operated by a user, said operating element extending at least partly in a circumferential direction of the closure, said actuating region is partly separated from the remaining regions of the sidewall of said flip-top lid by a slit, said slit extending at least partly in a circumferential direction of the closure, and said actuating region is connected with the remaining regions of the sidewall of said flip-top lid by at least one deformable hinge section biasing said actuation region into its latching position; wherein said closure comprises at least one frangible bridge, connecting said skirt of said base element with said actuation region of said sidewall of said flip-top lid, wherein said at least one frangible bridge is arranged such that it is destroyed when said latching element of the actuating region is disengaged from the corresponding latching portion of the container for the first time.

2. The closure according to claim 1, wherein said slit in said sidewall extends in a circumferential direction of said sidewall by an angle of 20° to 120°.

3. The closure according to claim 1, wherein said slit in the said sidewall at least partly extends into a direction different than the circumferential direction, which is in a direction perpendicular to said circumferential direction or at least with a component being perpendicular to said circumferential direction and/or which is in a direction towards the skirt of the base element.

4. The closure according to claim 1, wherein the slit has a width in the area of 0.2 mm to 1.5 mm.

5. The closure according to claim 1 wherein said at least one deformable hinge section is arranged such that a tilting angle of said actuating region or an angle between the latching position and the release position of said actuating region is at least 5°.

6. The closure according to claim 1, wherein said actuating region and said at least one deformable hinge section are arranged such that an axis (R) of tilting or rotating of said actuating region is positioned below said operating element or is, in a vertical direction, positioned in an area between said operating element and said latching element of said actuating region.

7. The closure according to claim 1, wherein the closure is arranged such that a straight line (L) connecting an axis (R) of tilting or rotating of said actuating region with a radially most outward point of said operating element forms an angle (β) with said sidewall of said flip-top lid (200) or with a vertical direction in a range of between 30° to 60°.

8. The closure according to claim 1 wherein said skirt of said base element has an upper rim, said upper rim or said skirt having a recess extending over a predetermined angular range in the circumferential direction, wherein said sidewall of said flip-top lid has a lower rim, said lower rim or said sidewall having a protrusion extending over a predetermined angular range in the circumferential direction, said protrusion of said sidewall of said flip-top lid extending into said recess of said skirt of said base element when said flip-top lid is in its closed position.

9. The closure according to claim 1, wherein said closure comprises a folding strap or folding ring attached to said skirt of said base element for attaching and/or fastening said closure to the container.

10. The closure according to claim 1, wherein said latching element of said actuating region comprises a protrusion at an inner surface of said sidewall and/or comprises a recess at an inner surface of said sidewall.

11. The closure according to claim 1, wherein the thickness of the actuation region is smaller in an upper region than in a lower region or is smaller in a region being further away from said latching element than in a region being closer to said latching element.

12. The closure according to claim 1 in combination with a container for holding a flowable medium, the container comprising a neck with a dispensing opening and with attachment means for attaching a closure, the closure attached to the neck of the container.

13. The closure in combination with a container according to claim 12, wherein said container comprises a ring-like protrusion at the outer circumference of said neck thereby forming a latching portion, which is engaged with the corresponding latching element of said actuating region of said closure when the flip-top lid of said closure is in its closed position and when actuating region is in its latching position.

14. A closure for a container, the closure comprising:

a base element;

a flip-top lid attached to said base element by a hinge such that the flip-top lid can be moved between an opened and a closed position;

said base element having a skirt with attachment means for attaching the closure to the container, said flip-top lid having a top cover and a sidewall, characterized in that said sidewall of said flip-top lid comprises an actuating region with a latching element, said latching element being positioned at an inner surface of said actuating region, wherein said actuating region is tiltable and/or deformable relative to the remaining regions of said sidewall between a latching position and a release position, said actuating region with said latching element being arranged such that said latching element is, when being in its latching position, engageable with a corresponding latching portion of the container, while the flip-top lid cannot be moved out of its closed position when said latching element of said actuating region is engaged with the corresponding latching portion of the container, said actuating region has, at an outer surface thereof, an operating element extending outwardly from said actuating region for being operated by a user, said operating element extending at least partly in a circumferential direction of the closure, said actuating region is partly separated from the remaining regions of the sidewall of said flip-top lid by a slit, said slit extending at least partly in a circumferential direction of the closure, and said actuating region is connected with the remaining regions of the sidewall of said flip-top lid by at least one deformable hinge section biasing said actuation region into its latching position; wherein the closure is arranged such that the necessary amount of a force applied onto said operating element in order to disengage said latching element of said actuating region from the corresponding latching portion of the container is higher when a force ($F_A$) is applied onto said operating element or said flip-top lid in a vertical upward direction compared to a force ($F_U$) which is applied onto said operating element having also a radially inwardly directed component.

15. The closure according to claim 14, wherein said operating element extends in a circumferential direction of said sidewall by an angle of 20° to 120°.

16. The closure according to claim 14 wherein said operating element is at least partly curved, being either arched towards the position of the slit in the sidewall or arched in a vertical upward direction.

17. The closure according to claim 14, wherein said operating element extends, in a radial outward direction from the sidewall, by a distance of 1 mm to 10 mm.

18. A closure for a container, the closure comprising:

a base element;

a flip-top lid attached to said base element by a hinge such that the flip-top lid can be moved between an opened and a closed position;

said base element having a skirt with attachment means for attaching the closure to the container, said flip-top lid having a top cover and a sidewall, characterized in that said sidewall of said flip-top lid comprises an actuating region with a latching element, said latching element being positioned at an inner surface of said actuating region, wherein said actuating region is tiltable and/or deformable relative to the remaining regions of said sidewall between a latching position and a release position, said actuating region with said latching element being arranged such that said latching element is, when being in its latching position, engageable with a corresponding latching portion of the container, while the flip-top lid cannot be moved out of its closed position when said latching element of said actuating region is engaged with the corresponding latching portion of the container, said actuating region has, at an outer surface thereof, an operating element extending outwardly from said actuating region for being operated by a user, said operating element extending at least partly in a circumferential direction of the closure, said actuating region is partly separated from the remaining regions of the sidewall of said flip-top lid by a slit, said slit extending at least partly in a circumferential direction of the closure, and said actuating region is connected with the remaining regions of the sidewall of said flip-top lid by at least one deformable hinge section biasing said actuation region into its latching position; and comprising at least one further frangible bridge, bridging said slit in said sidewall, said at least one further frangible bridge being arranged such that it is destroyed when said latching element of the actuating region is disengaged from the corresponding latching portion of the container for the first time.

* * * * *